United States Patent [19]

Gray

[11] Patent Number: 4,897,989

[45] Date of Patent: Feb. 6, 1990

[54] METHOD TO PRODUCE THREE-PLY YARN AND FABRIC MADE THEREFROM

[75] Inventor: Coy J. Gray, Greenwood, S.C.

[73] Assignee: Milliken Research Corporation, Spartanburg, S.C.

[21] Appl. No.: 257,610

[22] Filed: Oct. 14, 1988

Related U.S. Application Data

[62] Division of Ser. No. 121,697, Nov. 16, 1987, Pat. No. 4,848,413.

[51] Int. Cl.[4] ..... D02G 1/20; D02G 1/18; D02G 3/04; D02G 3/38

[52] U.S. Cl. ..... 57/239; 57/236; 57/245; 57/908; 57/289; 57/6

[58] Field of Search ..... 57/210, 225, 226, 227, 57/228, 236, 238, 239, 243, 244, 245, 246, 908; 78/247, 258; 139/397

[56] References Cited

U.S. PATENT DOCUMENTS

| | | | |
|---|---|---|---|
| 3,013,325 | 12/1961 | McNally | 139/397 |
| 3,110,151 | 11/1963 | Bunting | 57/980 X |
| 3,534,540 | 10/1978 | Collingwood et al. | 57/239 |
| 3,604,470 | 9/1971 | Zindwer | 57/239 X |
| 3,948,033 | 4/1976 | Henstock et al. | 57/908 X |
| 4,051,660 | 10/1977 | Griset | 57/908 X |
| 4,060,970 | 12/1977 | Talbot | 57/247 X |
| 4,164,117 | 8/1979 | Talbot | 57/289 |
| 4,219,997 | 9/1980 | Hatcher | 57/245 |
| 4,228,640 | 10/1980 | Talbot | 57/908 X |
| 4,304,092 | 12/1981 | Bridges | 57/6 |
| 4,341,063 | 7/1982 | Southerland et al. | 57/6 |
| 4,365,466 | 12/1982 | Horiuchi et al. | 57/908 X |
| 4,368,612 | 1/1983 | Eschenbach | 57/6 |
| 4,495,760 | 1/1985 | Vanhelle | 57/6 |
| 4,497,099 | 2/1985 | Scott | 28/220 |
| 4,578,940 | 4/1986 | Negishi et al. | 57/239 X |

*Primary Examiner*—Donald Watkins

*Attorney, Agent, or Firm*—Earle R. Marden; H. William Petry

[57] ABSTRACT

A novel pile fabric and method of making the pile fabric which employs a three-ply yarn having one yarn being textured and the other two yarns being non-textured to provide a wool-like appearance to the fabric and eliminate the tendency of such a fabric to finger mark.

2 Claims, 3 Drawing Sheets

METHOD TO PRODUCE THREE-PLY YARN AND FABRIC MADE THEREFROM

This is a division of application Ser. No. 121,697 for NOVEL METHOD TO PRODUCE 3-PLY YARN AND FABRIC MADE THEREFROM filed 11/16/87, now Pat. No. 4,848,413.

This invention relates to the manufacture of a plush pile fabric employing a novel three-ply yarn which, when woven into a double-plush fabric and cut provides a fabric surface which has a wool-like appearance and reduced finger marking tendencies.

An object of the invention is to provide a woven or knit double plush pile fabric which employs a novel three-ply yarn to reduce the finger marking on the surface of the fabric after it has been cut.

Other objects and advantages of the invention will become readily apparent as the specification proceeds to describe the invention with reference to the accompanying drawings, in which.

Figure 1:
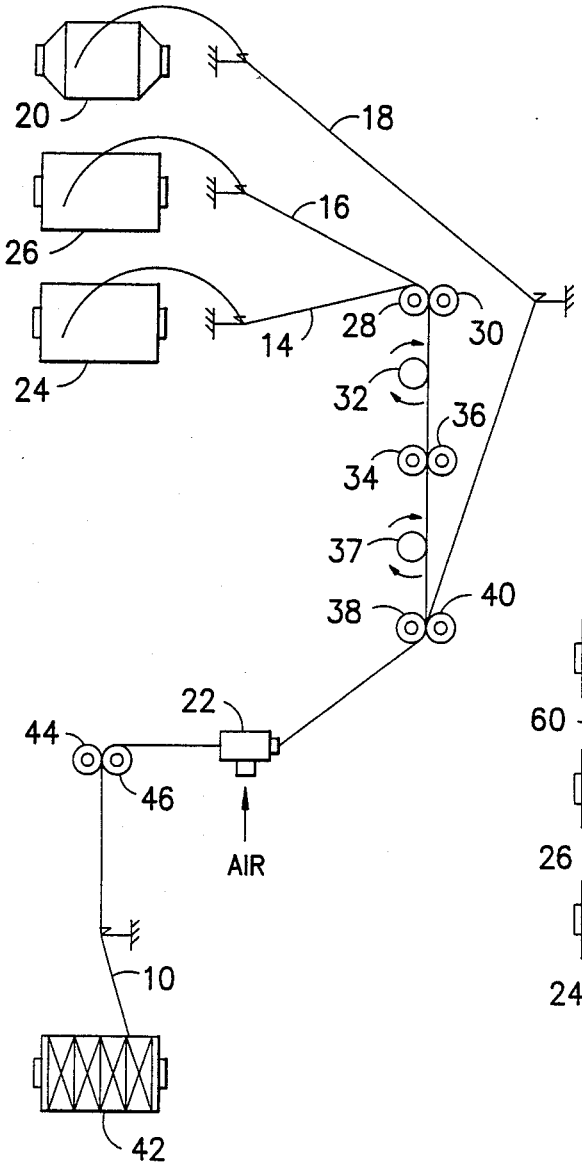
FIG. 1 is a schematic representation of one method of manufacturing the novel three-ply yarn.
Figure 2:
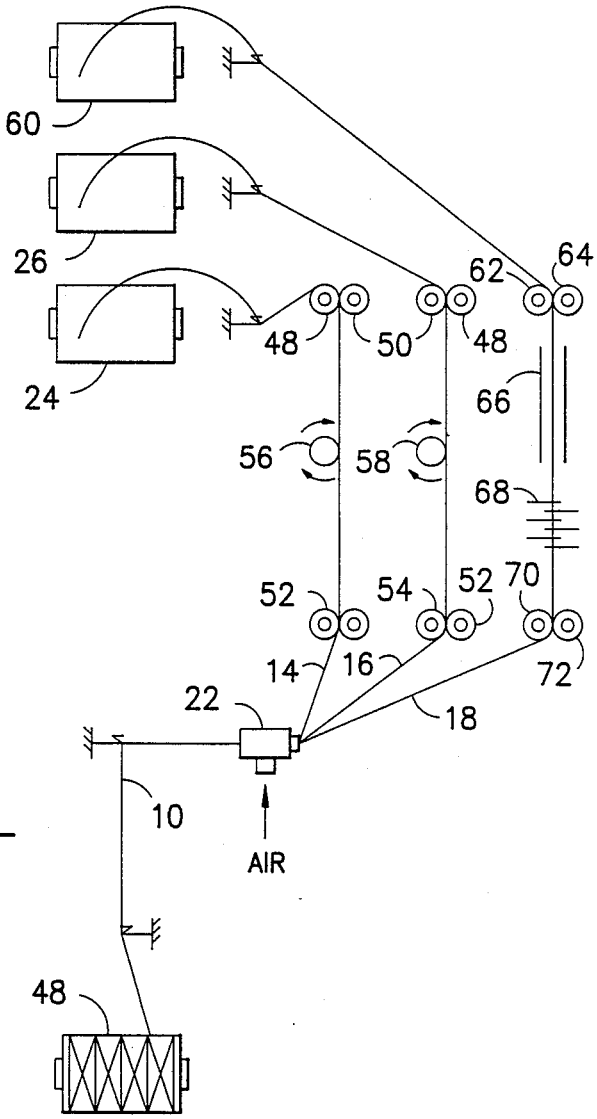
FIG. 2 is a schematic representation like FIG. 1 showing a modification thereof.
Figure 4:
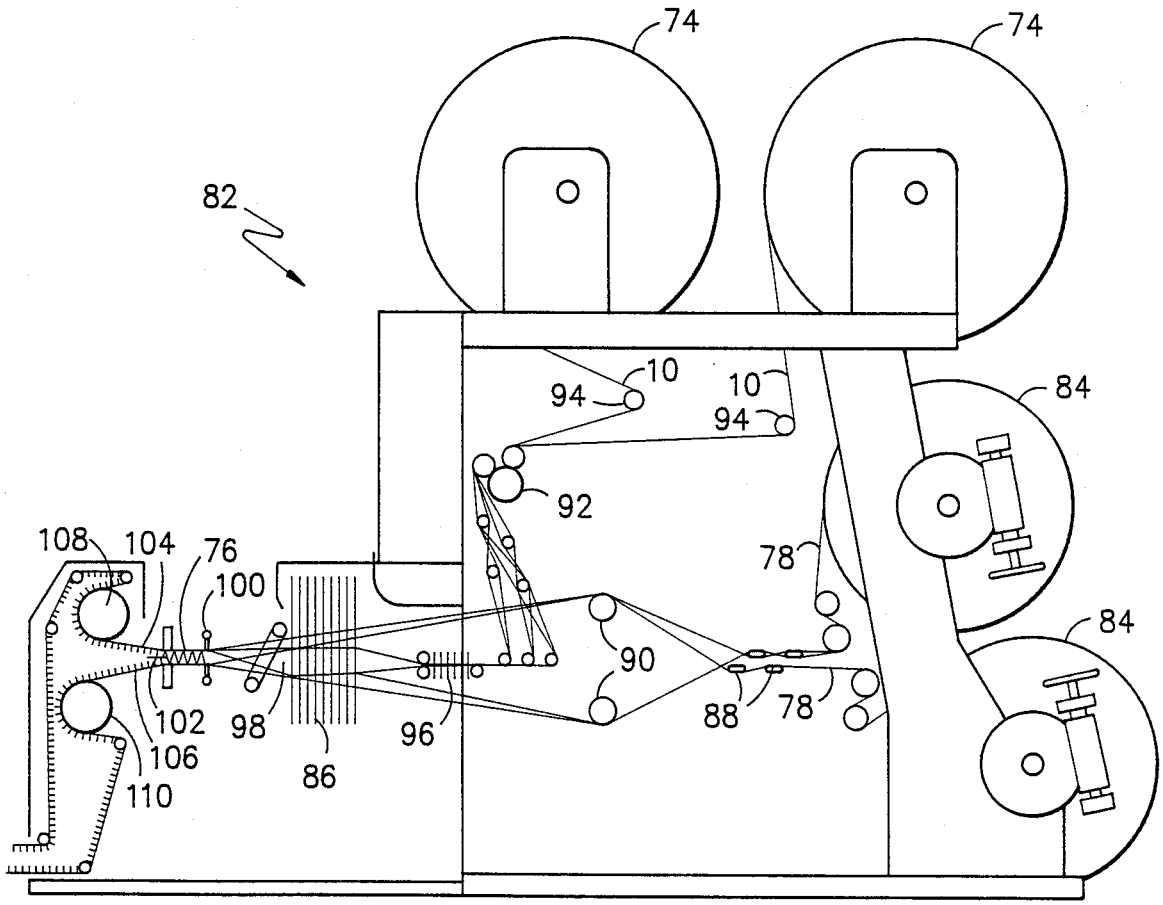
FIG. 4 is a schematic representation of the loom arrangement to make the fabric of FIG. 3.
Figure 5:
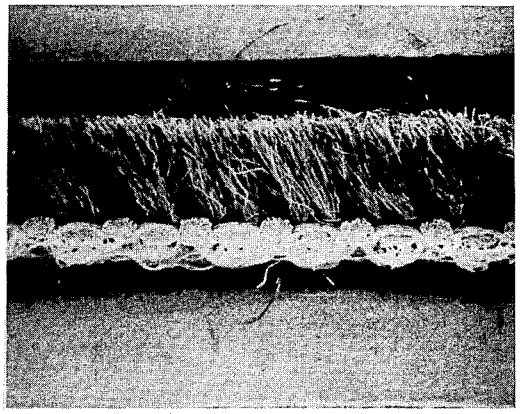
Figure 6:
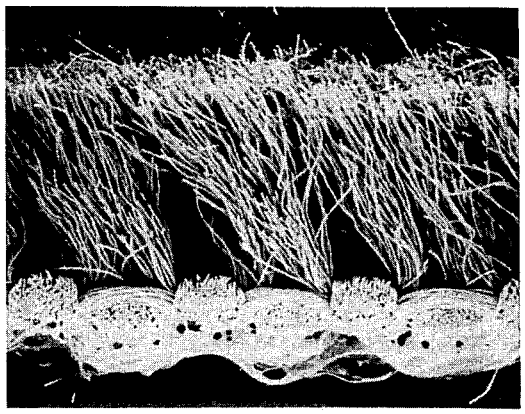
Figure 7:
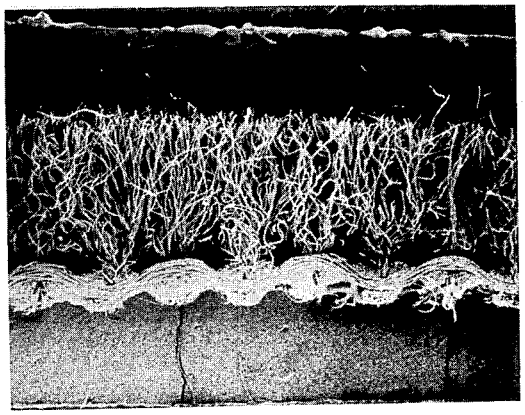
Figure 8:
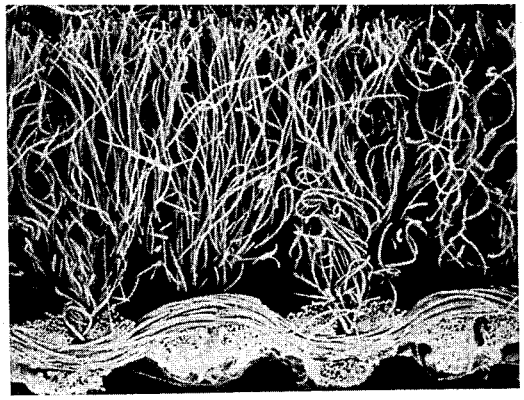

FIGS. 5 and 6 are blown-up cross-sectional views of a plush fabric made on the loom of FIG. 4 using a convetional pile yarn; and FIGS. 7 and 8 using the yarn of FIGS. 1 and 2 as the pile yarn.

Figure 3:
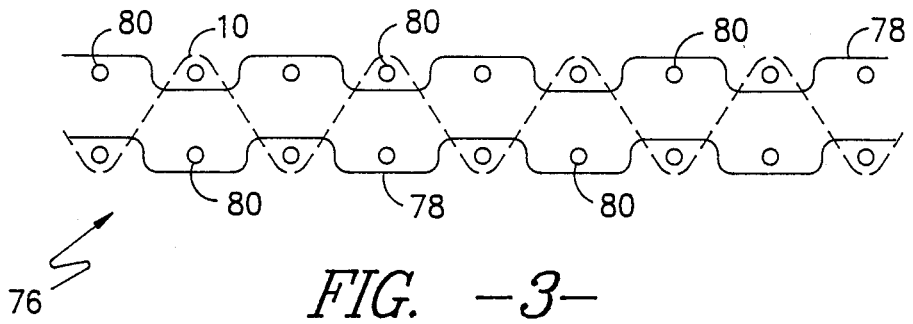
FIG. 3 is a schematic representation of a double woven fabric using the yarn of FIGS. 1 or 2 as the pile yarn.

Looking now to FIGS. 1 and 2 there is shown two methods to produce substantially the same pile yarn 10 to be used in the fabric 12 of FIGS. 3, 7, and 8. The yarn 10 basically consists of two ends 14,16 of drawn Dacron yarn commingled together with a single end 18 of textured Dacron yarn. In the form of the invention in FIG. 1, the textured yarn is delivered from a package 20 of textured yarn while in FIG. 2, the textured yarn 18 is textured in line with the commingling air jet 22.

In FIG. 1, the yarns 14 and 16 are 255 denier, 68 filament, 56-T Dacron drawn off the packages 24 and 26 and merged together, respectively, by the rolls 28 and 30 and delivered at a rate of 276 meters/minute. From the rolls 28 and 30, the yarns 14 and 16 are passed around the hot pin 32, maintained at a temperature of approximately 140° C., and drawn by the rolls 34 and 36 at a rate of 470 meters/minute. The drawn yarn then passes around the hot pin 37, maintained at a temperature of approximately 160° C., and is allowed to relax as it passes to the nip of rolls 38 and 40 whereat it merges with the 150 denier, 34 filament 56T Dacron false twisted yarn 18 delivered from the package 20 at the rate of 452 meters/minute. From the nip of the rolls 38 and 40, the yarns 14 16, and 18 are supplied through the commingling air jet nozzle 22 operating at a pressure of 150 p.s.i. wherein they are commingled and then commingled three-ply yarn 10 is delivered therefrom to the take-up package 42 at a rate of 400 meters/minute by the rolls 44 and 46.

The three-ply yarn 10 in FIG. 2 is generally similar to that produced by the method of FIG. 1 and is produced by commingling the yarns 14, 16, and 18 in the air jet 22 operating at about 70 p.s.i. and taking the commingled yarn up on the take-up package 48 at a rate of approximately 480 meters/minute. In this form of the invention, the yarns from the package 24 and 26 are each 255 denier, 68 filament, 56T Dacron and are drawn separately between pairs of rolls 48,50 and 52,54 as they pass around the hot pins 56 and 58 from the rolls 48,50 to the rolls 52,54. The hot pins 56 and 58 are maintained at a temperature of 155° C. as the yarn from the rolls 48,50 passes at a rate of 297 meters/minute while the rolls 52,54 are drawing at a rate of 505 meters/minute.

The yarn from the package 60, which is a 255 denier, 34 filament, 56T Dacron yarn, is drawn by the rolls 62,64 at a rate of 297 meters/minute and is successively, heated on the heater 66, false twisted at 68 and drawn by the rolls 70,72 which are delivering yarn at a rate of 500 meters/minute. The heater 66 is operating at a temperature of approximately 190° C. As previously mentioned the textured yarn 18, along with the drawn untextured yarns 14 and 16 are commingled together in the air jet 22 and taken up on the yarn package 48.

In the preferred form of the invention the yarn produced by the methods of FIGS. 1 and 2 will be wound from the packages 42 or 48 onto a warp beam 74 for use as the pile yarn in a fabric, such as that schematically represented in FIG. 3, made on a double rapier weaving machine. Obviously, the pile yarn from the packages 42 or 48 could be creeled and supplied to the weaving machine but the use of warp beams is preferred.

FIG. 3 represents a face to face plain velvet fabric 76 woven on a double rapier weaving machine with the yarn 10 being the pile yarn of the fabric shown in FIGS. 7 and 8 after the fabric 76 has been severed. In the preferred form of the invention, the pile yarn is the yarn described in FIGS. 1 and 2, the warp or ground yarn 78 is a three-ply, 150 denier, 34 filament textured 56T Dacron and the fill yarn 80 is a two-ply, 300 denier, 68 filament 56T textured Dacron.

To produce the fabric shown in FIG. 3 and the fabric shown in FIGS. 7 and 8, the conventional double rapier weaving machine 82 shown in FIG. 4 is used. As shown, the pile fabric yarn beams 74 are mounted on top of the weaving machine and the warp beams 84 for the ground warp yarn 78 are mounted as shown. The fill yarn 80 is inserted by double rapiers (not shown) from a creel downstream of the harness 86. In conventional manner, the warp yarn 78 is supplied over lease or tension rods 88 and guided by rolls 90 while the pile yarn 10 is delivered by feed roll 92 and guided by rolls 94. The pile yarn 10 as passes through the drop wires 96 is delivered into the harness 86 along with the ground warp yarns 78 and the fill yarns 80 inserted thereafter in conventional manner at 98. The reed 100 then completes the beat up action of the loom to provide the fabric shown in FIG. 3. After the beat up of the fabric 76, the knife 102 severs the fabric in the middle thereof to provide two pile fabrics 104 and 106 which guided from the weaving machine by suitable take-up rolls 108 and 110. The fabrics produced in the herein described machine and process are similar to that shown in cross-section in FIGS. 7 and 8.

FIGS. 5 and 6 show a fabric 104 or 106 which is woven without the herein novel pile yarn and it can be seen that all the pile fibers tend to lean in one direction which, when rubbed, results in the phenomena called "finger marking" and a tendency to show streaks. The fabric also may allow grin through of the backing fabric since the fibers all lay in one direction and since the tuft stems are not fully open.

FIGS. 7 and 8 show a fabric 104 or 106 which incorporates the novel pile yarn and it is obvious that the pile fibers are not oriented in any particular alignment which will not allow finger marks or streaks to form in the surface of the fabric. Furthermore, the disorientation of the fibers provides a wool-like appearance which reduces "grin through" as well as providing a better tuft lock of the fiber due to the interentanglement.

Although the preferred embodiment of the invention has been specifically described, it is contemplated that many changes may be made without departing from the scope or spirit of the invention, and it is desired that the invention be limited only by the claims.

I claim:

1. The method of producing a three-ply yarn comprising the steps of: supplying a pair of partially oriented synthetic filament yarns, drawing the pair of yarns, supplying the pair of drawn yarns along with a third false twist textured yarn into the air jet, supplying air under pressure into said air jet, commingling the pair of drawn yarns and the false twisted yarn in the air jet and taking up the commingled yarn.

2. A three-ply multi-filament synthetic yarn comprising: a pair of drawn filament yarns commingled with a false twist textured filament yarn.

* * * * *